United States Patent [19]

Marquez, Jr. et al.

[11] Patent Number: 4,465,139

[45] Date of Patent: Aug. 14, 1984

[54] VALVE AND SENSING DEVICE FOR WELL CONDUITS

[75] Inventors: Vincent F. Marquez, Jr., Woodlands; R. Edward Payne; Thomas L. Loveday, both of Houston; Robert J. Gunn, Missouri City, all of Tex.

[73] Assignee: Baker Oil Tools, Inc., Orange, Calif.

[21] Appl. No.: 373,594

[22] Filed: Apr. 30, 1982 (Under 37 CFR 1.47)

[51] Int. Cl.[3] ..... E21B 34/14; E21B 43/12

[52] U.S. Cl. ..... 166/373; 166/65 R; 166/332

[58] Field of Search ..... 166/65 R, 66, 72, 73, 166/113, 142, 196, 250, 264, 325, 332, 334, 373, 386, 387

[56] References Cited

U.S. PATENT DOCUMENTS

| | | | |
|---|---|---|---|
| 3,134,441 | 5/1964 | Barry et al. | 166/142 |
| 3,327,781 | 6/1967 | Nutter | 166/264 |
| 3,791,445 | 2/1979 | True | 166/332 |
| 4,050,512 | 9/1977 | Giebeler | 166/334 |
| 4,094,359 | 6/1978 | King | 166/332 |

*Primary Examiner*—Stephen J. Novosad
*Assistant Examiner*—William P. Neuder
*Attorney, Agent, or Firm*—Norvell & Associates

[57] ABSTRACT

A method and apparatus for installing in a well conduit by a single trip on an auxiliary conduit a combination well condition sensing device and flow cut off valving elements. The cooperating valving elements are of annular configuration and the auxiliary conduit passes through the bore of the valving elements and is mechanically connected to one of the valving elements. The entire apparatus may be run into the well conduit in a single trip on the auxiliary conduit and actuated to a flow shut off position by longitudinal manipulation of the apparatus. Pressurization of the upper well conduit and secondary manipulation of the apparatus and the auxiliary conduit permits the return of the valving elements to an open flow position.

14 Claims, 6 Drawing Figures

VALVE AND SENSING DEVICE FOR WELL CONDUITS

BACKGROUND OF THE INVENTION

1. Field of the Invention

The invention relates to a combination flow shut off valve and well condition sensing device for downhole installation in a well conduit immediate to a producing zone.

2. Description of the Prior Art.

In the completion of oil or gas wells, it is essential that accurate measurements be taken of various parameters involved in the production zone, such as fluid pressure and temperature. Experience has shown that more reliable measurements are obtained when the condition sensing device is positioned closely adjacent the producing zone and upward flow of produced fluids is entirely shut off. Additionally, certain important operating parameters are best determined by measurements taken first after a flow shut off, then re-opening the shut off valve to permit fluid flow, then shutting off the flow and taking an additional set of measurements.

Downhole shut off valves have heretofore been utilized but have been characterized by relatively complex structures requiring a plurality of trips into the well to install and a plurality of trips to remove from the well at the completion of the tests. There is, therefore, a distinct need for a downhole shut off valve operable in conjunction with a condition sensing device which can be installed in a single trip of an auxiliary conduit into the well. Where the sensing device is electric, it would be highly advantageous to accomplish the run-in and flow shut off with an electric wire line.

SUMMARY OF THE INVENTION

The invention provides a method of installing and operating a well condition sensing device, and an improved valving apparatus incorporating a well condition sensing device which can be installed in the wall with a single trip of an auxiliary conduit and operated by such auxiliary conduit. The fluid flow cut off apparatus is defined by a tubular outer body assembly within which a hollow mandrel is axially slidably mounted. An external annular elastomeric seal is provided on the tubular outer body to cooperate with a seal bore provided in the well tubing at a point immediately above a production zone. Such elastomeric seal is normally not in sealable contact with the seal bore but can be compressibly expanded to effect a sealing engagement with the seal bore by upward movement of the mandrel. Additionally, an internal annular seal bore or valve seat is provided in the outer body which is engaged by an annular seal on the hollow mandrel when it is moved to an upper position relative to the tubular body. Thus fluid flow around or through the tubular outer body is cut off.

Typically, an electric well condition sensing device is mounted in the bore of the hollow mandrel and an electric wire line traverses the bores of the tubular outer body and is mechanically connected to the hollow mandrel and electrically connected to the electric well condition sensing device. The entire valving and sending apparatus is run into the well. on the electric wire line and, after being positioned in the well conduit at a point above the production zone through the operation of conventional radially shiftable lock elements, or by other similar and known means, the application of tension to the electric wire line will produce an upward movement of the hollow mandrel which will concurrently expand the external annular elastomeric seal on the tubular body assembly into engagement with the adjacent seal bore on the well conduit, such as a landing profile nipple, and effect a sealing engagement of the annular seal on the mandrel with the seal bore or valve seat.

Preferably, a compressed helical spring is mounted between the tubular body assembly and the hollow mandrel to urge the hollow mandrel downwardly to its open flow position wherein fluid can flow through ports in the side wall of the tubular body, around the hollow mandrel and into the bore of the tubular body.

With the described apparatus, the flow cut off valving mechanism and the sensing device can be concurrently run into the well on a conventional electric wire line, slick line, tubular member or other auziliary conduit, and the flow cut off device manipulated to its closed position through the application of a modes tension to the electric wire line. Subsequent application of fluid pressure to the well conduit above the valving device, and release of the tension on the electric wire line, will effect the return of the hollow mandrel downwardly to its flow open position.

BRIEF DESCRIPTION OF THE DRAWINGS

FIGS. 1B and 1C being respectively vertical continuations of FIGS. 1A and 1B.

DESCRIPTION OF PREFERRED EMBODIMENTS

Figure 1A:
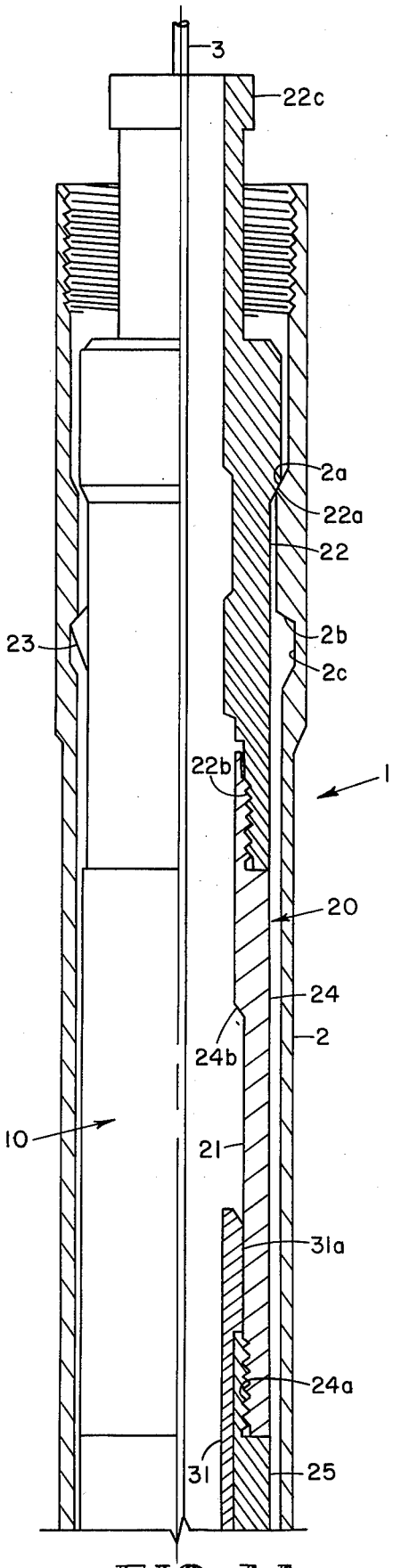
FIGS. 1A, 1B and 1C collectively represent a vertical cross sectional view of a well condition sensing device and valving assembly embodying this invention, shown in assembled relationship in a well conduit with the valving elements disposed in their open or flow position.

Referring to the drawings, there is shown a well conduit 1 which extends into a production zone (not shown). The well conduit 1 may comprise a well casing or a liner, production tubing, and, in any event, constitutes the primary conduit by which production fluid from the well is transmitted to the surface. Well conduit 1 includes a special nipple section 2 threadably connected in the conduit string and defining at its upper end an outwardly facing, inwardly projecting, annular no-go shoulder 2*a*. Below the no-go shoulder 2*a*, the special nipple 2 is provided with a downwardly facing locking shoulder 2*b* above an annular recess 2*c*. Below the locking shoulder 2*b*, the special nipple 2 is provided with an extended length of seal bore surface 2*d* having a greater diameter than the minimum diameter of the no-go shoulder 2*a*.

The combination well condition sensing device and flow cut off valve is represented generally by the numeral 10. Such assembly is run into the well on a conventional electric wire line 3, slick line, tubular member or other auxiliary conduit, the connection of which to the assemblage 10 will be hereinafter described. Assemblage 10 includes an outer tubular anchor housing assemblage 20, an annular elastomeric seal 26, a seal compression assemblage 30, and a hollow mandrel 40. Seal compression assemblage 30 is mounted for axially slidable movement relative to the outer tubular housing assembly 20 by an upwardly projecting sleeve 31 which slidably engages a bore portion 21 of the anchor housing assembly 20. The hollow mandrel assembly 40 is in turn slidably mounted within a downwardly extending sleeve 32 secured to the lower end of the annular seal compression assembly 30 for axial movements relative to the seal compression assembly.

The upper end of the outer tubular anchor housing assembly 20 includes an anchor sub 22 which defines at its top end, a downwardly facing annular stop shoulder 22*a* which engages the no-go shoulder 2*a* of nipple 2 and positions the entire assembly 10 relative to the special nipple 2. Anchor sub 22 further includes a plurality of peripherally spaced, radially shiftable lock elements 23 which are of conventional construction and urged by springs (not shown) or other biasing means to a radially outer position so that when the lock elements 23 are positioned opposite the recess 2*c* immediately below the locking shoulder 2*b*, they will spring outwardly into engagement with recess 2*c* and thus restrain the entire assembly 10 from upward movement relative to the well conduit 1, as shown in FIG. 1A.

Anchor sub 22 is connected by threads 22*b* to the upper end of a spacer sub 24 which in turn is connected by threads 24*a* to the upper end of a seal mounting sub 25. Seal mounting sub 25 defines an annular recess at its lower end to accommodate, in conventional fashion, an annular elastomeric seal 26. The diameter of seal 26 is selected to be less than the minimum diameter of the no-go shoulder 2*a* so that the seal 26 may readily pass such shoulder; however, the seal 26 is expandable through compressive forces produced by upward movement of the seal compression assembly 30 to expand such seal into intimate sealing engagement with the seal bore surface 2*d* of the special nipple 2.

The seal compression assembly 30 includes a compression sub 33 which is threadably secured by threads 33*b* at its upper end to the guide sleeve 31 and by threads 33*c* at its lower end to the mandrel guide sleeve 32. Compression sub 33 includes an outwardly and downwardly inclined top surface 33*a* which engages a correspondingly shaped surface on the annular elastomeric seal 26. Hence, upward movement of the seal compression assembly 30 will effect a compression of annular seal 26 and an outward displacement of said seal into sealing engagement with the seal bore surface 2*d*. Additionally, the compression sub 33 is provided with a plurality of peripherally spaced radial equalizing ports 34 which provide communication to the annulus from the interior of the inserted assembly 10 and the bore 1*a* of the well conduit 1 to the interior bore of the inserted assembly for a purpose to be hereinafter described.

The upstanding guide sleeve 31 is provided at its upper end with a radially enlarged shoulder portion 31*a* which cooperates with the upper end of the seal mounting sub 25 to limit the downward movement of the seal compression assembly. An internally projecting shoulder 24*b* provided on the spacer sub 24 limits the upward movement of the guide sleeve 31 relative to the anchor assembly 20.

As previously mentioned, hollow mandrel assembly 40 is mounted within the bore of depending guide sleeve 32 for relative axial movements with respect to the compression sub 33. More specifically, a head portion 41 of the hollow mandrel 40 is provided with a reduced diameter axial bore 41*a* and an exterior enlarged shoulder portion 41*b* which slidably engages the internal bore surface 32*a* of guide sleeve 32. The limits of axial movement of head 41 are determined at the top by the compression sub 33 and at the bottom by an inwardly projecting shoulder 32*b* formed on the bottom end of the guide sleeve 32.

A plurality of peripherally spaced radial fluid flow ports 32*d* are provided in guide sleeve 32 below the compression sub 33. In the open flow position of the mechanism shown in FIGS. 1A, 1B and 1C, produced fluid will flow upwardly around hollow mandrel assembly 40 and through ports 32*d* into the bore of anchor housing assembly 20 and thence through the bore of the well conduit 1 to the surface.

Figure 2A:
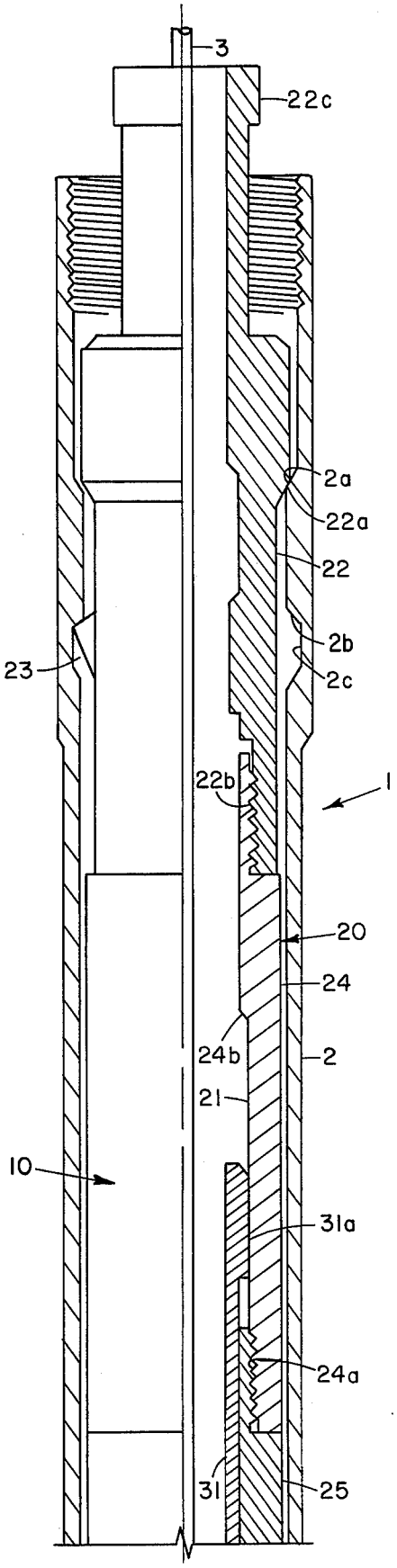
FIGS. 2A, 2B and 2C are views similar respectively to FIGS. 1A, 1B and 1C, but showing the valving elements in their flow cut off position.

The upper end of the head 41 of the hollow mandrel assembly 40 is provided with an upwardly facing sloped surface 41*e* which engages a correspondingly shaped downwardly facing surface 33*d* formed on the interior of the compression sub 33. The inter-engagement of these surfaces will cause the compression sub 33 to be moved upwardly by the hollow mandrel 40 to the fluid cut off position shown in FIGS. 2A, 2B and 2C.

In this fluid cut off position, a pair of O-rings 46 mounted on the periphery of the head 41 of the hollow mandrel assembly 40 engage a seal bore or valve seat 33*e* defined in the compression sub 33. Fluid flow through the ports 32*d* is therefore effectively blocked from entering the bore of the hollow tubular assemblage 20. Concurrently, the annular elastomeric seal 26 is urged outwardly into sealing engagement with the seal bore surface 2*d* of the well conduit 1 to eliminate fluid flow around the inserted assemblage 10, as clearly shown in FIGS. 2A, 2B and 2C.

The lower portion of the head 41 is provided with an enlarged counter-bore recess 41*c* within which is mounted an electric wire line anchor 42. The bottom end of the electric wire line 3 is mechanically secured in conventional fashion to the wire line anchor 42. Anchor 42 in turn is sealably mounted in the counter-bore recess 41*c*. Depending from the cable anchor 42 is a mounting tube 51 for supporting desired electric pressure and/or temperature sending devices 50 to determine the well conditions. Electrical connections (not shown) are provided in tube 51 for connecting the electrical conductors in electric wire line 3 to sensing devices 50. Devices 50 are of conventional construction and are of the type that are electrically actuated and produce electric signals. The necessary supply of current to devices 50 and the return of the electric signals generated to the surface is accomplished by the electrical conductors conventionally incorporated in the electric wire line cable 3.

The lower end of head portion 41 is threadably secured as by threads 41*d* to the upper end of an externally threaded sleeve 43. An internally threaded spring anchor ring 44 is adjustably positioned on the external threads of sleeve 43. A compression spring 45 is mounted between anchor ring 44 and the bottom end of the depending guide sleeve 32, and thus imparts a downward bias to the hollow mandrel assemblage 40 urging it to the position shown in FIGS. 1B and 1C.

While it is not essential, other types of mechanically actuated well condition sensing devices 60 may be mounted on the bottom end of sleeve 42 by being threadably connected to a thread cross-over sub 48. Such mechanically actuated pressure and temperature measuring devices may be provided as insurance against the failure of the electric type sensing devices 50.

OPERATION

In the operation of the described mechanism, the entire assembly including the electric sensing devices 50, the hollow mandrel assembly 40, the seal compression assembly 30 and the outer tubular anchor assembly 20 are lowered into the well on electric wire line 3. As mentioned, when the shoulder 22*a* on the anchor sub 22 of the outer tubular anchor assembly 20 seats on the no-go shoulder 2*a* in the special nipple 2, the locks 23 move radially outwardly into the aligned annular nipple recess 2*c* and are engagable with the downwardly facing nipple shoulder 2*b* to prevent further upward movement of the inserted anchor body assembly 20 relative to the well conduit 1.

Figure 1B:
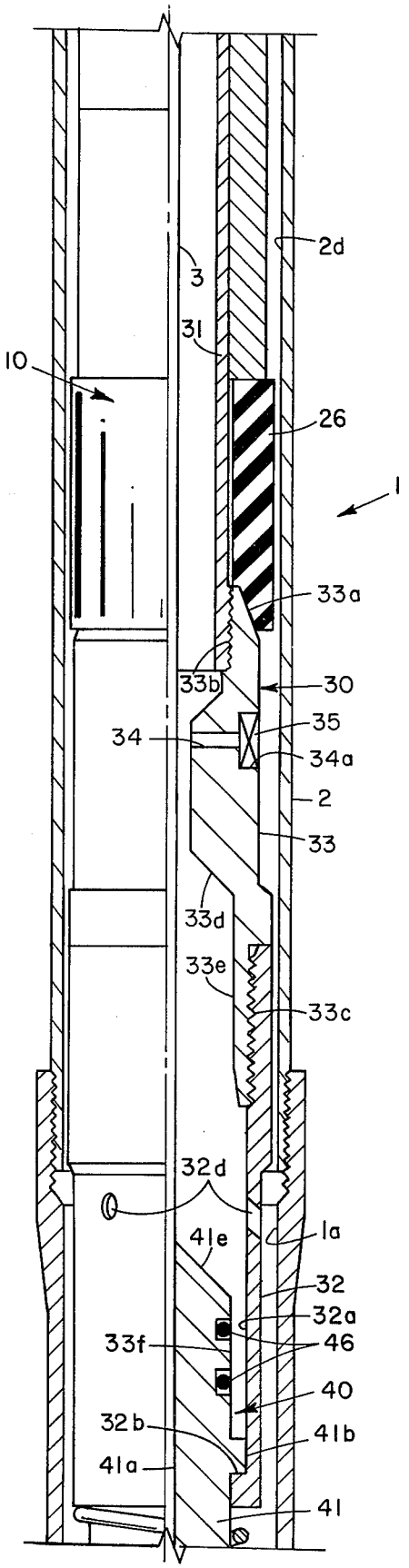
Figure 1C:
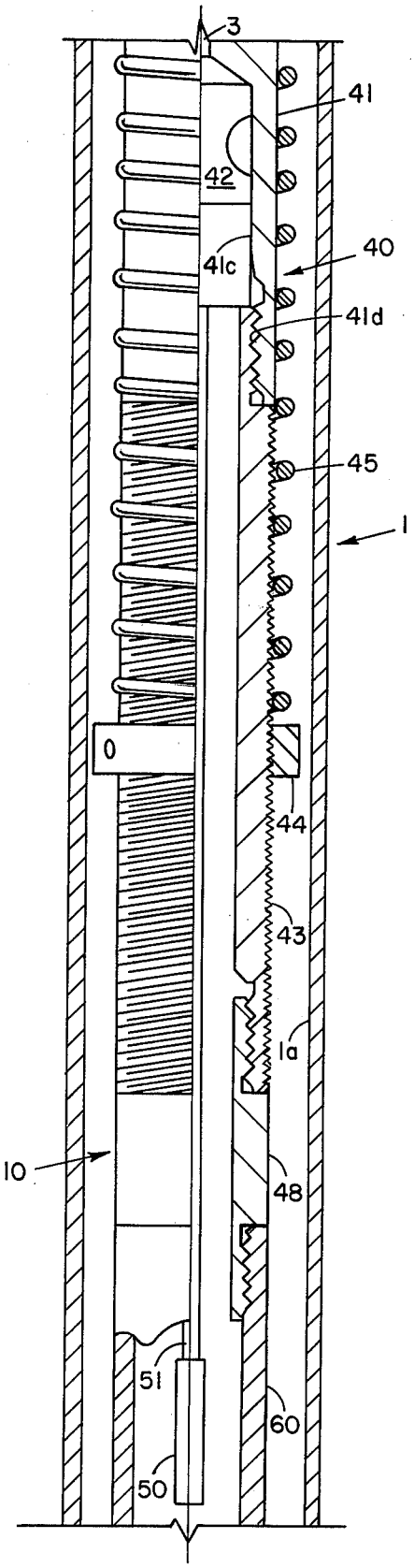

In the position of the apparatus shown in FIGS. 1B and 1C, well fluids can flow freely upwardly around the exterior of the hollow mandrel assembly 40 and enter the interior bore of the inserted assembly 10 through the peripherally spaced flow ports 32*d* provided in the ending guide sub 32. From this point, the fluid passes upwardly through the internal bore of the seal compression assembly 30 and the tubular anchor body assemblage 20.

Figure 2B:
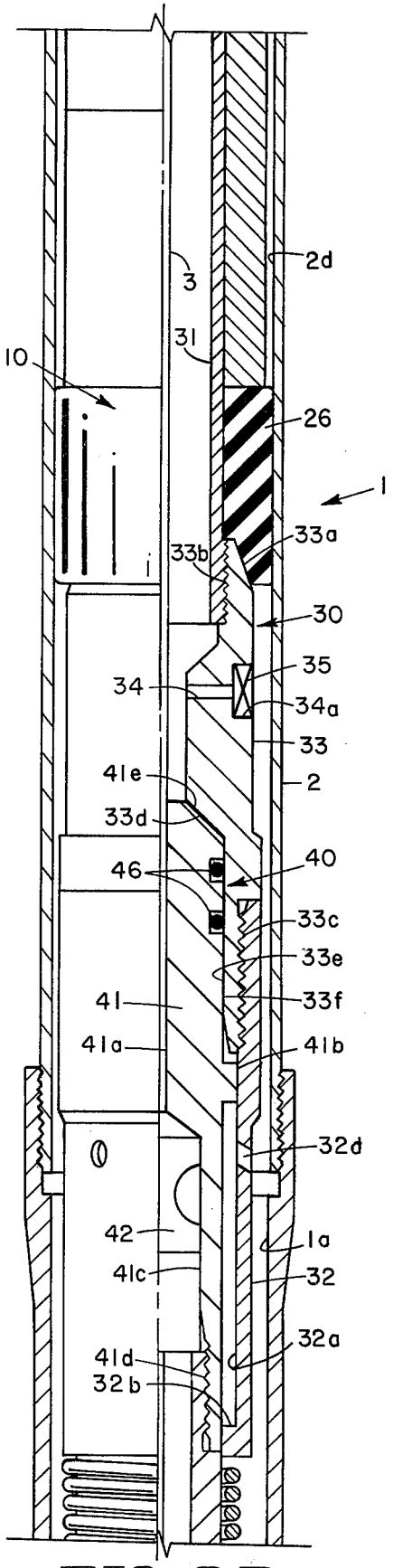
Figure 2C:
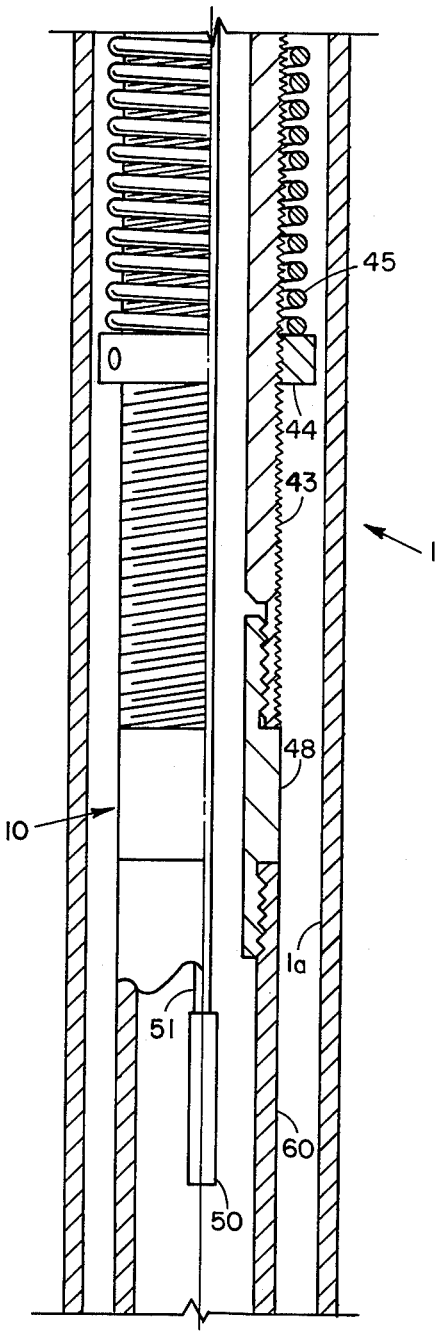

The applications of an upward tensile force to the electric wire line 3 will produce an upward movement of the hollow mandrel assembly 40 and thus Bring the O-rings 46 provided in the mandrel head portion 41 into sealing engagement with the seal bore 33*e* defined by the seal compression sub 33, as shown in FIGS. 2B and 2C. Additionally, the end face 41*e* of the head portion 41 of the hollow mandrel assembly 40 will engage the downwardly facing abutment surface 33*d* provided on the seal compression sub 33 and force the sub 33 upwardly, thus compressing the annular elastomeric seal 26 into intimate sealing engagement with the adjacent seal bore surface 2*d* of the special nipple 2.

It is therefore apparent that all fluid flow through the well conduit 1 in interrupted through the inter-engagement of the O-ring seals 46 with the seal bore surface 33*e*, thus preventing any fluid flow passing through the peripherally spaced flow ports 32*d* from entering the interior bore of the inserted assembly 10, while the compression and outward displacement of the annular elastomeric seal 26 prevents any fluid passage along the exterior of the inserted assemblage 10.

It is therefore apparent that the well condition sensing devices 50 and the flow control valving unit are concurrently run into the well in a single trip on an electric wire line. Furthermore, the valve elements may be repeatedly actuated to a closed position by applying an upward tensile force on the electric wire line sufficient to cause upward movement of the hollow mandrel assembly 40 into the valve closing position shown in FIGS. 2B and 2C.

To return the valving elements to their open flow position, as illustrated in FIGS. 1B and 1C, it is only necessary to relax the tension on the electric wire line 3 and then apply sufficient fluid pressure down the well bore, such as nitrogen gas, to equalize the formulation fluid pressure operating on the hollow mandrel assemblage 40 to hold it in an upward position. Such equalization of fluid pressure is conveniently achieved through the provision of the plurality of peripherally spaced ports 34 provided in the upper portion of the seal compression sub 33, between valve seat 33*e* and outer seal 26.

Each port 34 has an enlarged counter bore 34*a* and a conventional check valve 34 (shown only schematically in the drawings) mounted in each counter bore 34*a* which permits only outward flow through ports 34. Once the pressure differential across the hollow mandrel assembly 40 is removed or substantially reduced, the compressed spring 45, plus the weight of hollow mandrel assembly 40 will effect the return of the hollow mandrel assemblage to the position shown in FIGS. 1B and 1C.

At the completion of the testing operations, the aforedescribed mechanism may be conveniently removed from the well conduit. First the electric wire line 3 is sheared at a deliberately weakened zone provided immediately adjacent to the cable anchor 42. A conventional retrieving tool (not shown) having an equalizing prong or other means to actuate the valve 34 is then run into the well on a wire line and engages an upstanding fishing neck portion 22*c* provided on the top of the anchor sub 22. The retrieving tool incorporates conventional means for effecting the retraction of the locking dogs 23, following which the entire assemblage may be pulled from the well by the retrieving tool. The prong depresses a nub (not shown) on the valve 34 to equalize pressure across the device. Thereafter the retrieving tool engages the portion 22*c*. It is therefore apparent that a minimum of running operations are required to effect the installation of the combination tool in the well and its subsequent removal.

Those skilled in the art will recognize that the sealing arrangement between head portion 41 of the hollow mandrel assemblage 40 and the seal compression sub 33 is only typical of a number of well known sealing arrangements. Thus, the seal compression sub 33 could be provided with an elastomeric sealing material on the downwardly facing surface 33*d* which is engaged by the top surface 41*e* of the head portion 41 of the hollow mandrel assemblage 40. The essential feature is that a seal is achieved to interrupt fluid flow from the exterior of the tool into the bore through the cooperation of two annular valving elements, and the electric wire line for operating the valving elements passes through the bore of the two annular valving elements.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. For use in a well conduit, a flow shut off and testing assembly, comprising: a first annular means defining a valve seat; a second annular means defining a valve head; means mounting said first and second annular means in the conduit for relative axial movement between an open flow position wherein said valve head is spaced from said valve seat and a flow shut off position wherein said valve head is sealingly engaged with said valve seat; a well condition sensing device mounted in the bore of one of said annular means, said device being operated by an auxiliary conduit; and an auxiliary conduit traversing the bores of said first and second annular means and mechanically connected to said one annular means and operatively extending to said well condition sensing device, whereby longitudinal manipulation of said auxiliary conduit relatively shifts said first and second annular means to said flow shut off position.

2. The apparatus of claim 1 further comprising resilient means urging said first and second annular means to said open flow position.

3. For use in a well conduit, a flow shut off and testing assembly, comprising: first annular means defining a valve seat; a second annular means defining a valve head; means mounting said first and second annular means in the conduit for relative axial movement between an open flow position wherein said valve head is spaced from said valve seat and a flow shut off position wherein said valve head is sealingly engaged with said valve seat, a well condition sensing device mounted in the bore of one of said annular means, said device being electrically operated, and an electric wire line traversing the bores of said first and second annular means and mechanically connected to said one annular means and electrically connected to said well condition sensing device, whereby tension applied to said electric wire line will shift said first and second annular means to said flow shut off position.

4. For use in a well conduit having a seal bore surface above a producing zone, a flow shut off and testing assembly comprising: a tubular assembly defining an external elastomeric seal axially compressible to sealingly engage the seal bore surface; said tubular assembly further defining an interior annular valve seat; a hollow mandrel mounted in said tubular assembly for axial movement between a lower open flow position and an upper flow shut off position; means movable by said hollow mandrel to compress said annular elastomeric seal into sealing engagement with the seal bore in said upper flow shut off position; said hollow mandrel further defining an annular seal engagable with said interior annular valve seat in said upper flow cut off position of said mandrel; an electric well condition sensing device; and means for mounting said device in the bore of said hollow mandrel of said device, said means for mounting including means for effecting a mechanical connection of said hollow mandrel and an electrical connection of said sensing device to an electric wire line, whereby said hollow mandrel is shiftable to said flow cut off position by application of tension to the electric wire line.

5. The apparatus of claim 4 further comprising resilient means urging said hollow mandrel to said open flow position.

6. For use in a well conduit having a seal bore surface above a producing zone, a flow shut off and testing assembly, comprising: a tubular assembly defining an external elastomeric seal axially compressible to sealingly engage the seal bore surface; said tubular assembly further defining an interior annular valve seat; a hollow mandrel mounted in said tubular assembly for axial movement between a lower open flow position and an upper flow shut off position; means movable by said hollow mandrel to compress said annular elastomeric seal into sealing engagement with the seal bore in said upper flow shut off position; said hollow mandrel further defining an annular seal engagable with said interior annular valve seat in said upper flow cut off position of said mandrel; an electric well condition sensing device; and means for mounting said device in the bore of said hollow mandrel; a wire line anchor sealingly mounted in the bore of said hollow mandrel, said anchor including means for mechanical securement to an electric wire line and means for electrical connection of the electric wire line to said electric well condition sensing device, whereby said hollow mandrel is shiftable to said flow cut off position by application of tension to the electric wire line.

7. For use in a well conduit having a seal bore surface above a producing zone, a flow shut off and testing assembly, comprising: a tubular assembly defining an external elastomeric seal axially compressible to sealingly engage the seal bore surface; said tubular assembly further defining an interior annular valve seat; a hollow mandrel mounted in said tubular assembly for axial movement between a lower open flow position and an upper flow shut off position; means movable by said hollow mandrel to compress said annular elastomeric seal into sealing engagement with the seal bore in said upper flow shut off position; said hollow mandrel further defining an annular seal engageble with said interior annular valve seat in said upper flow cut off position of said mandrel; an electric well condition sensing device; means for mounting said device in the bore of said hollow mandrel, an electric wire line extending from the well surface through the well conduit, through said tubular assembly and into the bore of said hollow mandrel, a wire line anchor sealingly mounted in the bore of said hollow mandrel, said anchor including means for mechanical securement to said electric wire line and means for electrical connection of said electric wire line to said electric well condition sensing device, whereby said hollow mandrel is shiftable to said flow cut off position by application of tension to the electric wire line.

8. For use in a well conduit including a nipple located above a producing zone and defining a downwardly facing locking shoulder and a seal bore below the locking shoulder, a flow shut off and testing assembly, comprising: an outer tubular assemblage; radially shiftable lock elements mounted in said outer tubular assemblage and operable to engage the downwardly facing locking shoulder; an annular elastomeric seal mounted on said outer tubular assemblage and normally disposed in non-sealing relation to the seal bore surface; an annular seal compression element axially shiftably mounted on said outer tubular assemblage below said annular elastomeric seal, whereby upward movement of said annular seal compression element compresses said annular elastomeric seal into sealing engagement with the nipple seal bore; said annular seal compression element defining an internal seal bore and a downwardly facing annular shoulder; a radially ported sleeve depending from said annular seal compression element; a hollow mandrel supported in said ported sleeve for limited axial movement between a lower flow open position and an upper flow shut off position, resilient means urging said hollow mandrel to said flow open position, said mandrel having an upwardly facing surface engagable by upward movement with said downwardly facing surface of said annular seal compression element; said mandrel further having external annular seal means engagable with said internal seal bore defined by said annular seal compression elements in said upper flow closing position; and electric well condition testing device secured in the bore of said hollow mandrel, said device producing an electrical wire line to said hollow mandrel and electrically connecting the electric wire line to said well condition testing device, whereby the flow shut off and testing assembly is run into the well conduit by the electric wire line and actuated to a flow shut off condition by an upward force on the electric wire line.

9. The apparatus of claim 8 wherein said resilient means comprises biasing means disposing between said ported sleeve and a radial shoulder on said hollow mandrel.

10. The apparatus of claim 9 wherein said radial shoulder comprises a ring threadably secured to the periphery of said hollow mandrel, thereby permitting axial adjustment of said ring to vary the compressive force in said biasing means.

11. The apparatus defined in claims 4, 5, 6, or 7 further comprising a pressure equalizing radial port in said tubular assembly intermediate said annular elastomeric seal and said interior annular valve seat, and a check valve permitting only radially outward fluid flow through said pressure equalizing radial port.

12. The apparatus defined in claims 8, 9 or 10 further comprising a pressure equalizing radial port in said annular seal compression element above said internal seal bore, and a check valve permitting only radially outward fluid flow through said pressure equalizing radial port.

13. The method of installing and operating a well condition sensing device in a well conduit comprising the steps of:

1. mounting a hollow mandrel for axial movement relative to a tubular anchoring assemblage, the tubular anchoring assemblage having an external elastomeric seal compressibly expanded by relative upward movement of the hollow mandrel to engage the well conduit, and an internal seal bore concurrently sealingly engaged by the hollow mandrel;
2. mounting a well condition sensing device in the bore of the hollow mandrel;
3. passing an auxiliary conduit through the bore of the tubular anchoring assemblage and into the bore of the hollow mandrel;
4. mechanically connecting the auxiliary conduit to the hollow mandrel and operatively extending the auxiliary conduit to the well condition sensing device;
5. running the mandrel and anchoring assembly in the well conduit on the auxiliary conduit;
6. anchoring the tubular anchoring assembly to the well conduit at a position above a production zone, and
7. applying tension to the auxiliary conduit to move the hollow mandrel and cut off upward fluid flow, thereby permitting effective sensing by the well condition sensing device.

14. The method of claim 13 further comprising the steps of applying fluid pressure to the well conduit to equalize fluid pressure on said hollow mandrel and then releasing tension on the electric wire line to permit the mandrel to fall to a flow open position.

* * * * *